United States Patent [19]

Crawford et al.

[11] 4,183,437

[45] Jan. 15, 1980

[54] RACK HOLDER ARRANGEMENT FOR DISHWARE

[75] Inventors: John G. Crawford; Thomas E. Jenkins, both of Louisville, Ky.

[73] Assignee: General Electric Company, Louisville, Ky.

[21] Appl. No.: 860,515

[22] Filed: Dec. 14, 1977

[51] Int. Cl.[2] ..... A47F 5/01

[52] U.S. Cl. ..... 211/41; 312/311

[58] Field of Search ..... 211/41, 74, 151, 162, 211/181, 183; 312/311, 351, 228, 229; 220/19; 134/57 D, 58 D, 138, 139, 172, 158, 187, 144, 148

[56] References Cited

U.S. PATENT DOCUMENTS

| | | | |
|---|---|---|---|
| 1,884,181 | 10/1932 | Pauly | 211/41 |
| 2,712,826 | 7/1955 | Schleyer et al. . | |
| 2,745,417 | 5/1956 | Fielding | 211/41 E X |
| 2,841,288 | 7/1958 | Field et al. | 211/41 |
| 2,971,652 | 2/1961 | Getchell et al. | 211/41 |
| 3,098,685 | 7/1963 | Stiner et al. | 312/311 |
| 3,124,251 | 3/1964 | Guth | 211/41 R |
| 3,146,045 | 8/1964 | Kauffman | 312/311 X |
| 3,174,489 | 3/1965 | Jellies et al. . | |
| 3,454,019 | 7/1969 | Leedy . | |

*Primary Examiner*—Roy D. Frazier
*Assistant Examiner*—Robert W. Gibson, Jr.
*Attorney, Agent, or Firm*—H. Neil Houser; Radford M. Reams

[57] ABSTRACT

A rack holder for large diameter items of dishware of varying depths such as plates and bowls, including an arrangement of dish holder wire form elements mounted to a rack frame which efficiently accommodates either shallow depth items such as plates or deeper items such as bowls while maintaining a stable, slightly inclined vertical positioning of these items. The arrangement includes a succession of aligned pairs of dish holder elements of alternate configuration. One is comprised of upwardly extending fingers and the other of diverging substantially shorter elements. Both configurations are spaced and formed so as to securely engage shallow depth plates between successive pairs of elements of either configuration, while the divergent elements accommodate deeper bowl items allowing them to be received between the upwardly extending fingers. Particular dimensions and configuration of the elements accommodate the arrangement to a wide variety of dishware. The holder arrangement properly positions the dishes to be particularly adapted to dishwashing machine racks.

19 Claims, 10 Drawing Figures

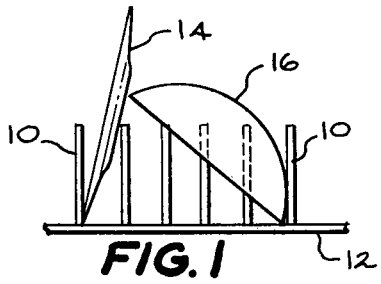
FIG. 1
PRIOR ART
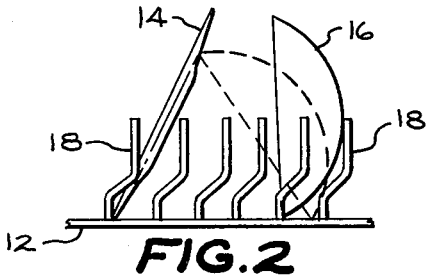
FIG. 2
PRIOR ART
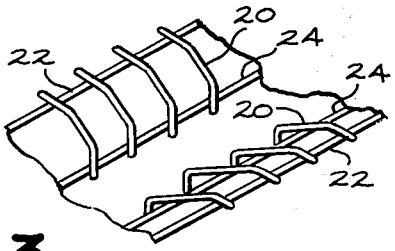
FIG. 3
PRIOR ART
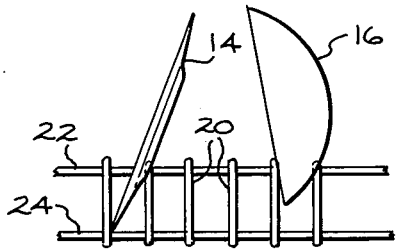
FIG. 4
PRIOR ART
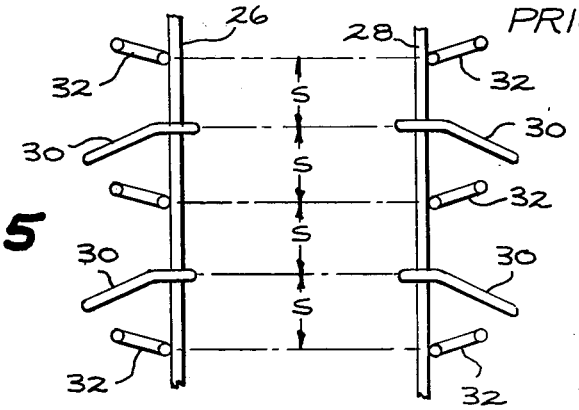
FIG. 5
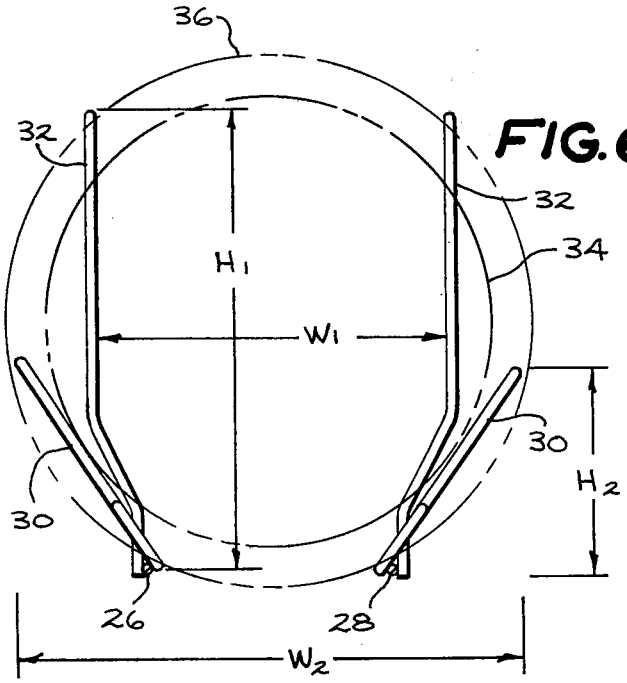
FIG. 6
FIG. 7
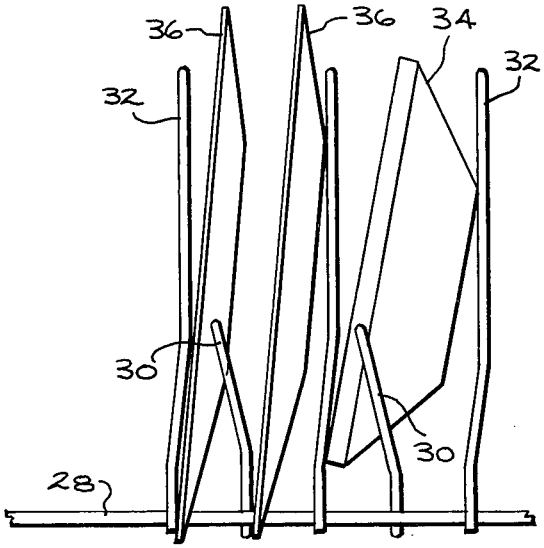

RACK HOLDER ARRANGEMENT FOR DISHWARE

BACKGROUND DISCUSSION

Dish holder racks such as are used in dishwashers should desirably accommodate the item to be held in a manner which is efficient in its use of space such as to maximize the capacity of the dishwasher. These racks must also securely position the items so held in an attitude and spacing which is compatible with the washing system of the particular dishwasher. A recurrent problem has been in rack design for relatively large diameter items such as plates and bowls. Many dishwashers require that these items be securely positioned in a substantially vertical or slightly tilted position. An excessive degree of leaning forward or backward may result in improper washing action. In addition, the rack holder should be able to accommodate standard dinner plates and items of a deeper depth, such as soup and salad bowls.

Racks for this class of dishware usually take the form of spaced pairs of wire form elements, either fingers, doglegs or knees, as will be described hereinafter in more detail, which are equally spaced. The spacing of these elements is difficult to properly establish such as to both accommodate the varying depth items and also to provide adequate stability of the items to be supported in a vertical or nearly vertical attitude in the rack. The vertical inclination of the dishes, while necessary for proper washing action, also contributes to maximum efficiency in utilization of space within the dishwasher. This is because the overhead space provided for these racks takes into account the fact that these items are generally of relatively great diameter such that an overhead clearance within the dishwasher is established such as to accommodate the largest diameter plate or tray to be held. Accordingly, the vertical or overhead space above the rack should be utilized to maximum extent possible, and a vertical orientation or positioning of these items within the rack affords maximum efficiency in terms of utilizing space.

Of course, in any such consumer item which is manufactured in great numbers as are dishwashers, the cost of manufacture is of great significance and any such dish holder arrangement must be relatively simple and easily manufactured so as to minimize the costs involved.

It is accordingly an object of the present invention to provide a dish holder arrangement particularly adapted to dishwasher applications for large diameter items of varying depth such as to accommodate plates and bowls. This arrangement provides for a secure positioning of all of the items to be accommodated in a slightly inclined from the vertical position, properly spaced from one another.

It is yet another object of the present invention to provide such a holder arrangement in which the items of varying depth are accommodated while achieving a highly efficient loading of the items in terms of maximum number of items in the dishwasher interior space.

It is still another object of the present invention to provide such a dish holder arrangement which is relatively simple and low in cost to fabricate.

SUMMARY OF THE INVENTION

These and other objects of the present invention, which will become apparent upon a reading of the following specification and claims, are accomplished by a dishwasher dish holder arrangement comprised of successive pairs of dish holder elements of alternate configurations mounted in a rack frame. One of the configurations comprises upwardly extending dish holder elements which may be comprised of wire form fingers while the other configuration is comprised of relatively short, diverging pairs of wire form elements. The height and inclination of the diverging elements is such as to allow deeper items to be positioned between the upwardly extending fingers while being configured to effectively interact with the upwardly extending element to securely position relatively shallow items such as plates. This is achieved in part by an inclination of each of the diverging elements towards a preceding finger pair so as to engage relatively narrow depth sections of the plates.

A specific embodiment as to size, configuration and spacing of these elements also allows for efficient accommodation of most dish sizes and shapes. This embodiment resides in a set of particular dimensions, angles of inclination and relationships between the extension of the upward elements and the diverging elements. The elements of each of the upwardly and diverging dish holding elements are mounted to a wire form member of a dishwasher rack frame in which several rows of the dish holder elements may be provided.

DESCRIPTION OF THE DRAWINGS

FIG. 1 is a diagrammatic representation of one form of the prior art dish holder arrangement.

FIG. 2 is a diagrammatic representation of an alternate variation of the prior art dish holder configuration shown in FIG. 1.

FIG. 3 is a perspective view of another prior art dish holder arrangement.

FIG. 4 is a diagrammatic representation of the prior art dish holder arrangement shown in FIG. 3 showing the loading of dishware items of varying depth.

FIG. 5 is a plan view of the dish holder element arrangement according to the present invention.

FIG. 6 is a front elevational view of the dish holder element arrangement shown in FIG. 5.

FIG. 7 is a side elevational view of the dish holder element arrangement according to the present invention shown in FIGS. 5 and 6 with various dishware items loaded therein.

DETAILED DESCRIPTION

Figure 8:
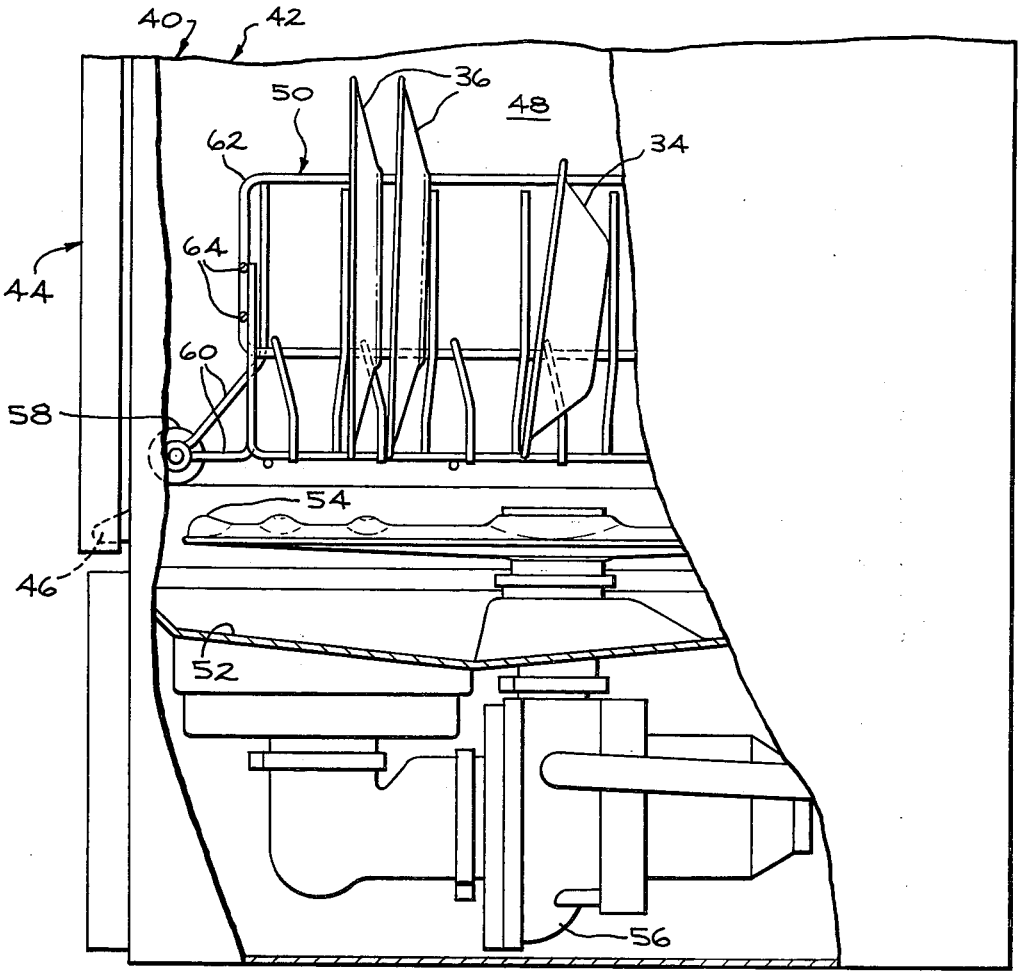
FIG. 8 is a side elevational view of a dishwasher incorporating the dish holder arrangement according to the present invention, the dishwasher cabinet being shown with portions broken away.

In the following detailed description, certain specific terminology will be utilized and a specific embodiment described in accordance with the requirements of 35 USC 112, but it is to be understood that the same is not intended to be limiting and should not be so construed inasmuch as the invention is capable of many forms and variations within the scope of the appended claims.

In order to clearly understand the concept of the present invention, a background discussion of the conventional prior art holding arrangements is here set forth.

As briefly mentioned above, it is an objective of proper design in dish holder racks intended for dishwasher applications that dishware of large diameter be generally vertically disposed, without being inclined either too far forwardly or rearwardly. This disposition is desirable in order to achieve proper washing action and also to efficiently utilize the dishwasher interior space. The dish holder arrangement should securely position these items such that the forces exerted during the washing cycle do not tend to reposition the items inclined too far forward or backward or into engagement with each other. Generally, this is achieved by a dish holder arrangement in which the items are slightly inclined from the vertical such that their weight tends to stabilize them in this position. This inclination is commonly achieved by interengagement with the base of one pair of a series of pairs of dish holder elements and in engagement with an opposite surface of the dishware item on the upper portions of the successive pair of dish holder elements.

The chief difficulty of previous designs has been in achieving this loading with items of varying depths. Various common prior approaches are shown in simplified form in FIGS. 1 through 4.

In FIG. 1, a series of pairs of straight fingers 10 are utilized secured to a rack frame 12. In order to accommodate the varying depths, the spacing of the finger pairs 10 is made somewhat wider than necessary to accommodate flat plates 14 so as to enable the placing of deeper bowls 16 inbetween these pairs. The net result, however, is that the plates 14 are inclined somewhat more from the vertical than is optimal for proper washing action and also maximum utilization of space. The bowls 16, on the other hand, cannot be tilted or inclined to the rear since the spacing of the finger pair 10 is not adequate for this purpose, so the tendency is for the bowls 16 to lean forward.

In an attempt to better accommodate the depth of the bowls, a variation of the finger configuration is sometimes resorted to in which doglegged fingers 18 are used, the idea being that the doglegged fingers 18 may be effectively at a wider spacing such that the bowl 16 may be secured in a more nearly upright position. However, as indicated in FIG. 2, this does not quite achieve the intended result in that the engagement for some bowl shapes and sizes results in a nearly vertical positioning of the bowl 16 which thus does not weight stabilize the attitude of the bowl 16 so that under the force of the washing sprays, the bowl may still pitch forward as indicated in phantom in FIG. 2. At the same time, the relatively flat plate items 14 are inclined even further from the vertical to compromise the washing and loading efficiency of these items.

Also sometimes used are "knees" instead of fingers in which the wire form knees 20 are secured to frame elements 22 and 24 at both the upper and lower ends of the knee elements 20. As seen in FIG. 4, these arrangements have similar disadvantages as the finger approach except that the bowl 16 may even be more unstably engaged by the successive knee pairs 20.

From this discussion, it can thus be appreciated that the ideal rack form would engage dishware items of this type through a range in which successive pairs of elements would engage these items such as to position them in a slightly inclined attitude such as to stabilize the position of the items in the rack. This engagement would ideally be the same for items throughout the depth range for which the dish holder arrangement was designed.

According to the concept of the present invention, successive pairs of dish holder wire form elements are disposed in a row, mounted to the dish holder rack frame. However, these dish holder elements are configured so that successive pairs of dish holder elements will engage relatively shallow dishware items such as plates to maintain proper positioning and spacing. However, for relatively deep items, such as salad and soup bowls, alternate pairs of dish holder elements are configured such that the bowls and deeper items may be positioned over these alternate pairs of dish holder elements and be engaged by the dish holder elements succeeding and preceding these alternate pairs of dish holder elements.

A particular configuration which achieves this result is shown in simplified form in FIGS. 5 through 7. The dish holder arrangement includes a rack frame means to which the dish holder element arrangements are mounted. A portion of such a rack frame means is indicated by a pair of longitudinal frame elements 26 and 28 which are secured to the remainder of the rack frame and which are spaced apart and extend in a parallel direction to each other. Affixed to each of the rack frame members 26 and 28 is a succession of dish holder elements of two different configurations, 30 and 32, alternately mounted. Each of the dish holder elements 30 and 32 is located opposite a like element on the respective opposite longitudinal frame member 26 or 28 such that aligned pairs of dish holder elements of each configuration are arranged in a row with alternate configurations of dish holder elements provided in the row.

Several of such rows could be provided in a dishwasher rack which will be described hereinafter.

The dish holder element 30 is comprised of wire forms affixed at one end to the rack frame means comprised of rack frame members 26 and 28 which extend outwardly away from each other such as to be diverging from each other and are inclined at a moderately steep angle from the plane defined by the point of securement of the ends of the rack frame elements 26 and 28.

The alternately configured dish holder elements 32, on the other hand, comprise wire forms which extend generally upward from the rack frame means and to a point substantially higher than the uppermost portion of the diverging elements 30, i.e., on the order of twice the height above the rack frame means.

The diverging elements 30 extend outwardly to a point outboard of the upwardly extending dish holder elements 32 such that at the point of the uppermost portions of the diverging dish holder 30 are spaced apart a distance approximately equal to the distance of the upwardly extending elements 32 above the rack frame means, i.e., the point where these elements are secured to the longitudinal frame members 26 and 28.

The configuration of the diverging element 30 and its position with respect to the upwardly extending element 32 is intended to result in a clearance for relatively deep items such as the bowls 34, such that bowls 34 may be received within the preceding and succeeding pairs of upwardly extending dish holder elements 32. The divergency at the central region produces this as indicated in FIG. 6, in which the contact points of the bowl configuration would allow positioning of the bowl 34 relatively close to the underlying rack frame means. At the same time, the outermost portions of the diverging elements 30 enable engagement of these end portions with the outer rim of the plates indicated by the circle 36. This enables the result of providing clearance for the bowl items 34 to be received well within the upwardly extending dish holder elements 32 while allowing the diverging elements 30 to properly engage the plates 36 such that succeeding pairs of dish holder elements 30 and 32 may engage the plates 36 to provide for relatively more closely spaced dish holder items in accordance with their relative depth with respect to the bowls 34.

Since generally the plates 36 are of somewhat greater diameter than the bowls 34, it has been found for most typical dishware sizes and shapes this result will be achieved.

A further feature of the configuration of the diverging dish holder element is desirable in order to properly engage the shallow depth items such as plates 36.

As shown in FIG. 7, the plates are positioned by contact with the bottom of each dish holder element 30 or 32 at the point whereat it is joined to the rack frame means and is engaged at an upper point on the dishwasher item by the next succeeding dish holder element. The plates 36 thus successively engage the base of the dish holder element 32 and then the diverging dish holder element pair 30. Since the point of contact of the upper portion of the dishware items 36 differs greatly between contact with the diverging element 30 or upwardly extending element 32 as can be appreciated from FIG. 7, the diverging element 30 is most likely to contact the plates 36 at a point along the sloping rim portion. This means that the depth of the plates 36 between the points of contact on successive dish holder elements is less than where the dishware item 36 is positioned at the base of a diverging element 30 and an upper point of an upwardly extending element 32.

The spacing of the contacts should thus be less in order to maintain the slightly inclined from the vertical position of the plates 36. Each of the diverging elements 30 has its outer end portion inclined towards the preceding upwardly extending element as indicated such that the point of the outer end portion contacting the dish is in closer spacing than the preceding base of an upwardly extending dish holder element 32 such that the proper inclination is maintained.

If the spacing of the dish holder element is uniform as is contemplated, the upwardly extending elements likewise are slightly inclined away or toward the succeeding diverging element pair as indicated in FIGS. 5 through 7 such as to produce a slightly greater spacing between the points of contact with the plates 36 such as to insure a slight rearwardly inclined positioning of the dish as shown.

Accordingly, it can be seen that the plates 36 may be securely positioned relatively closely spaced together at the proper angle, while insuring adequate clearance therebetween for proper washing action.

At the same time, the bowls 34 are very stably confined between the alternate pairs of upwardly extending elements 32 and reasonably efficiently occupy that space.

The particular dimensions and proportions have been discovered to be of significance in accommodating dishware of typical design and these significant dimensional and angular relationships are here set forth.

That is, it has been discovered that these particular configurations very effectively accommodate a wide variety of dishware items. The spacing S indicated in FIG. 5 has been determined to be approximately one inch while the spacing of the longitudinal frames 26 and 28 which define the point at which the diverging dish holder element 30 diverges in on the order of 3 inches. The overall height $H_1$ of the upwardly extending elements 32 has been established to be on the order of $5\frac{1}{2}$ to 6 inches, while the spacing $W_1$ is on the order of 4 to 5 inches. The diverging elements extend at a moderately steep angle to the plane defined by the successive points of attachment of the dish holder element and the rack frame means and this angle has been set at 56°, although any moderately steep angle, i.e., 45° to 65°, would be suitable. The height $H_2$ of the uppermost portions of the diverging dish holder elements as noted is substantially less than the distance $H_1$ and would be on the order of one-half the height $H_1$, i.e., $2\frac{1}{2}$ to 3 inches. The relative spacing apart of the uppermost portions $W_2$ would be on the order of the height $H_1$ of the upwardly extending elements 32, i.e., $5\frac{1}{2}$ to 6 inches; that is, somewhat greater in width than the spacing $W_1$ of the upwardly extending elements 32.

The offset of the terminal portions of the diverging dish holder element 30 was selected to be on the order of $\frac{3}{8}$ inch towards the preceding upwardly extending elements 32. These in turn are inclined on the order of 10° to 15° with an offset of approximately $\frac{3}{4}$ inch.

This arrangement has been found to accommodate dishware of $5\frac{3}{4}$ to $8\frac{1}{2}$ inches in diameter, and, with the spacing as described, of a depth of approximately up to 2 inches.

Figure 9:
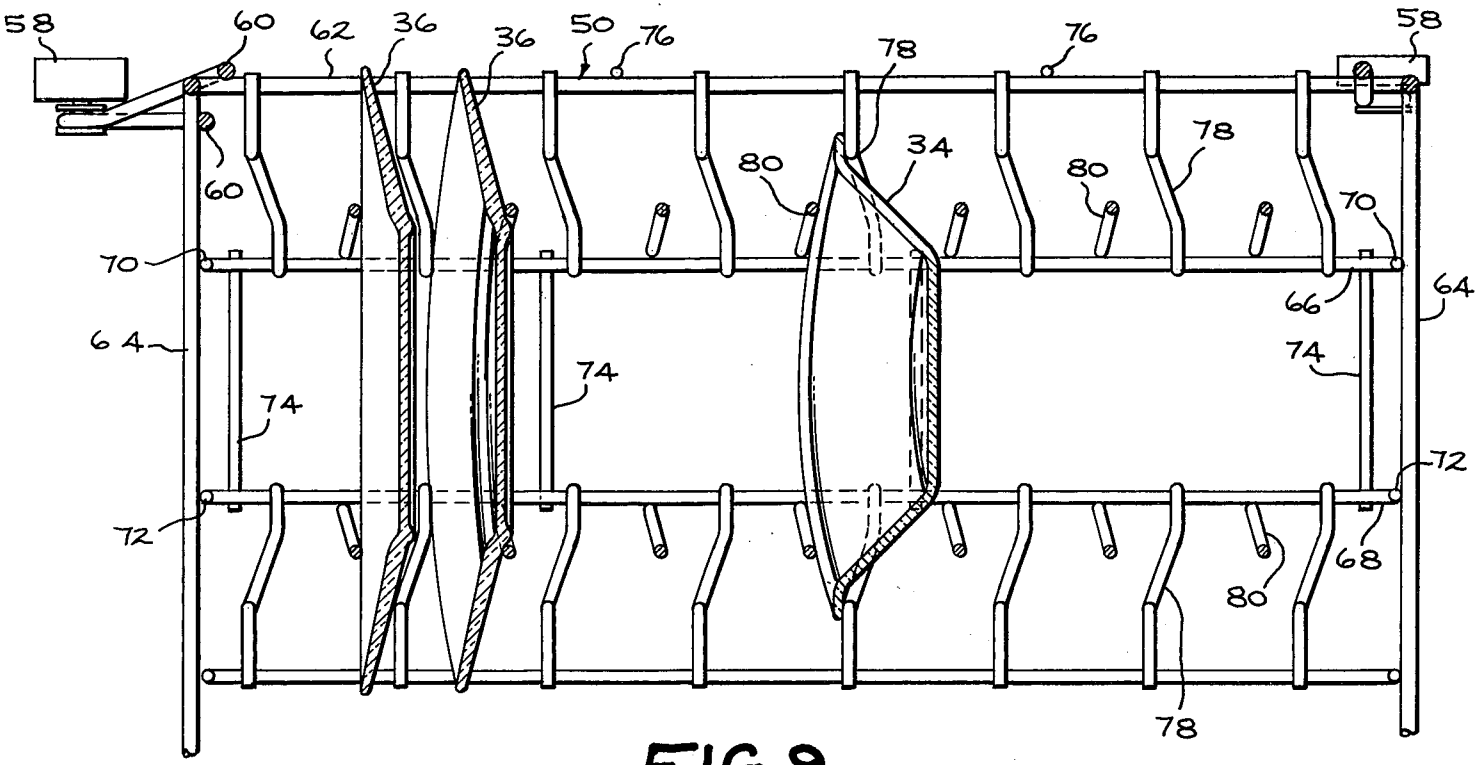
FIG. 9 is a plan view of a portion of the dishwasher rack incorporated in the dishwasher depicted in FIG. 8.
Figure 10:
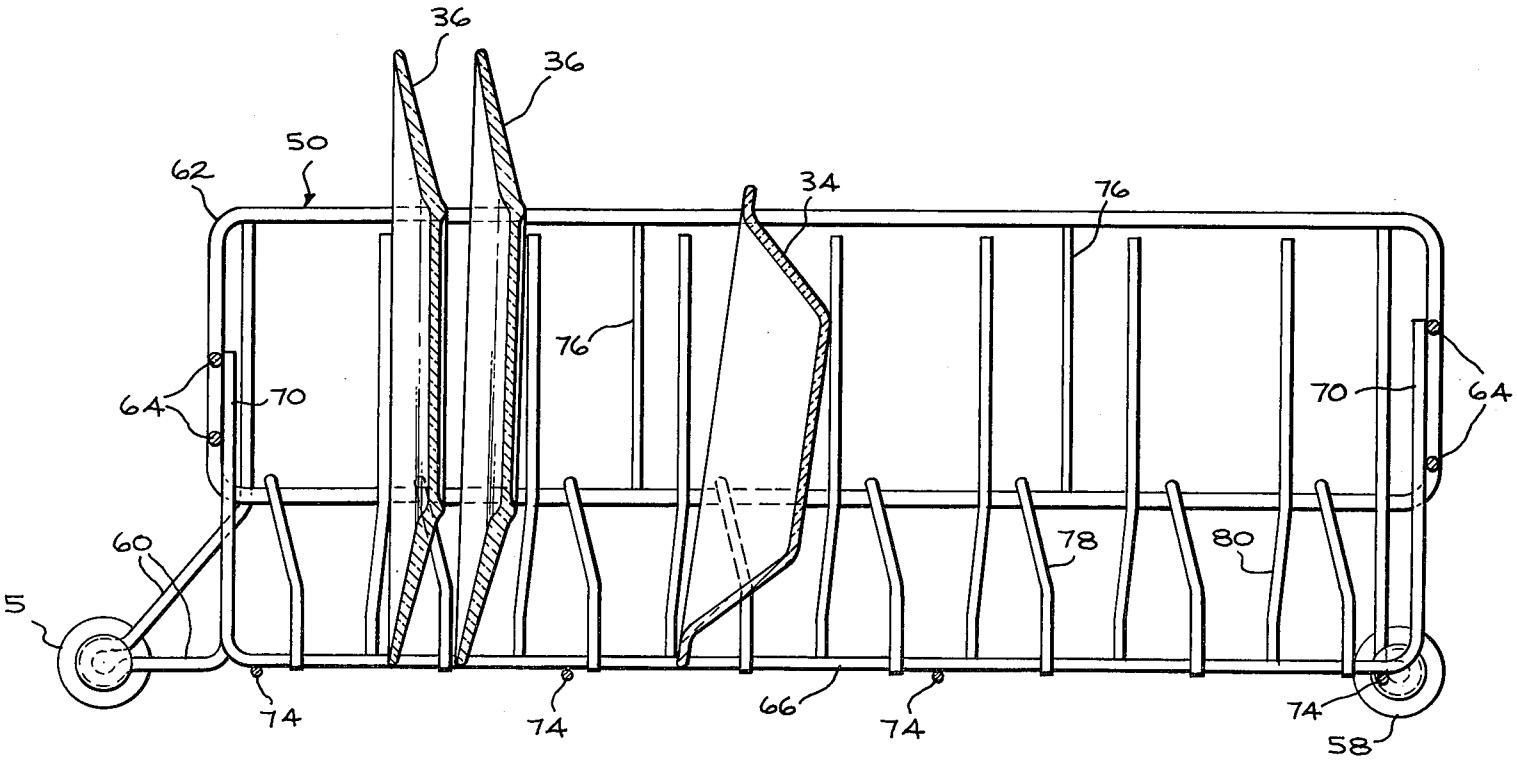
FIG. 10 is a side elevational view of the dishwasher rack in longitudinal section as shown in FIGS. 8 and 9.

Referring to FIGS. 8 through 10, a dishwasher 40 is depicted including dishwasher cabinet 42 having access door 44 hinged at 46 to provide access to the interior space 48. The interior space 48 is adapted to accommodate a plurality of dishwasher racks of varying configuration. The dish holding arrangement according to the present invention as noted has application to holding of relatively large diameter items such as soup and salad bowls 34 and dinner plates 36. These items, according to most dishwasher designs, are held in the lower dish holder rack indicated at 50 positioned within the interior space 48.

The dishwasher 40 also includes a molded tub 52 which serves to collect the water directed during washing over the dishes disposed within the interior space 48. The water is directed at the lower dish holder rack 50 by means of a rotary spray nozzle 54 which is supplied with rinse and wash water by a centrifugal pump 56 in conventional fashion.

The lower dish holder rack 50 is positioned within the interior space 48 by a plurality of rollers 58 supporting the lower dish holder rack 50 by rack members 60 rotatably supporting each roller 58 and secured to the lower dish holder rack 50. The rear rollers 58 (FIG. 10) are supported directly beneath the lower dish holder rack 50 and would include two or more rows of the dish holder element pairs as described above.

In FIGS. 9 and 10, one row is depicted. The lower dish holder rack 50 comprises a wire form frame including a peripheral pair of lateral loop sections 62 joined together by cross members 64 at the front and rear. Each row of the rack frame means comprises a pair of longitudinally extending U forms 66 and 68 corresponding to the longitudinal members 26 and 28 shown in FIGS. 5 through 7. Each U form 66 and 68 has upwardly extending legs 70 and 72, respectively, which are welded to the cross members 64 to be mounted thereto. Reinforcing cross pieces 74 may also be included and secured to the U forms 66 and 68. Reinforcing cross pieces 76 may also be provided to stiffen or reinforce the lateral loop section 62.

Secured to the U forms 66 and 68 are the successive pairs of dish holder elements of alternate configurations, the diverging dish holder elements 78 and the upwardly extending dish holder elements 80 corresponding to the dish holder elements as described above. In this embodiment, the diverging element 78 has its outer end secured to the dishwasher rack such that a "knee" configuration is provided. However, this arrangement is not necessary and a lower cost fabrication of the rack may be carried out by merely leaving the ends of the diverging element 78 free as indicated in FIGS. 5 through 7.

In similar fashion, the diverging element 78 extends from the longitudinal U forms 66 and 68 directly outwardly at a moderately steep angle to the bottom of the dishwasher rack 50 and extends outwardly and forwardly as viewed in FIG. 9 such as to engage the outer rims of the plates 36 while allowing the relatively deeper items such as the bowls 34 to be positioned over the diverging elements 78 so as to be retained by alternate pairs of the upwardly extending elements 80. The upwardly extending elements are inclined slightly to the rear as viewed in FIG. 9 for the purpose described above.

Accordingly, the rack can accommodate relatively shallow items such as dinner plates and deeper items such as bowls at a two-to-one ratio. It thus efficiently and stably positions these items with a proper spacing therebetween at an inclination for proper washing action and efficient utilization of the space within the dishwasher.

The wire frame construction is of the usual conventional design, i.e., steel wire covered with a suitable plastic encasement such as vinyl to preclude rust, scratching of the dishware items and for sanitary purposes.

Many variations in the specifics of this configuration of course are possible such as the noted variations in either leaving the uppermost ends of the diverging free element or joining them to the frame to create knees. While the specific dimensions, inclinations and configurations recited above have been discovered to very effectively accommodate normally configured dishware items, the invention of course is not limited to these particular specifications.

While the drawings have shown separate wire form elements to provide pairs of dish holder elements, such pairs could be provided by a single member with end portions bent to provide the dish holder element pairs.

The embodiments of the invention in which an exclusive property or privilege is claimed are defined as follows:

1. A dish holder arrangement comprising:

rack frame means;

a series of pairs of alternately configured dish holding elements mounted to said frame means arranged and mounted in a row to said frame means;

one of said configured pairs of said dish holding elements in said row being configured to extend generally upwardly from said frame means with the other configured pair of dish holder elements in said row extending upwardly from said frame means and outwardly in a divergent direction from each other and from said upwardly extending dish holder element pairs;

said divergent dish holder element pairs being of substantially less height above said rack frame means than said upwardly extending pairs of dish holder elements;

whereby said divergency of said diverging dish holder elements allows relatively deep dishware items to be received over said diverging dish holder elements and confined between successive pairs of said upwardly extending dish holder elements, while relatively shallower items may be supported on said rack frame means between successive pairs of said dish holder elements by engagement therewith.

2. The dish holder arrangement according to claim 1 wherein said diverging dish holder elements extend outwardly to a point outboard of said upwardly extending dish holder elements.

3. The dish holder arrangement according to claim 1 wherein said diverging dish holder elements have terminal portions thereof inclined towards a preceding pair of upwardly extending dish holder elements whereby said outer portions thereof may engage sloping rim surfaces of plate items and maintain said plate items in a generally vertical inclination by engagement with said outer portions and said preceding upwardly extending element pair.

4. The dish holder arrangement according to claim 3 wherein each of said upwardly extending dish holder elements is inclined towards a succeeding pair of divergent dish holder elements.

5. The dish holder arrangement according to claim 1 wherein said diverging elements extend upwardly from said rack frame means to a point whereat the distance between the uppermost portion of said diverging elements are spaced apart a distance approximately equal to the distance of said upwardly extending dish holder element above said rack frame means.

6. The dish holder arrangement according to claim 1 wherein said upwardly extending elements extend a distance approximately 5½ to 6 inches above said rack frame means.

7. The dish holder arrangement according to claim 1 wherein said diverging elements extend a distance above said rack frame means such that the uppermost portion of said divergent dish holder elements are spaced approximately 5½ to 6 inches apart.

8. The dish holder arrangement according to claim 1 wherein said rack frame means to which are mounted pairs of dish holder elements defines a plane at the point whereat said pairs are secured to said rack frame means, and wherein each of said divergent elements extends at a moderately steep angle to said plane and at an angle on the order of 45° to 65° with said plane.

9. The dish holder arrangement according to claim 8 wherein said divergent dish holder elements extend at an angle of 55° to 60° from said rack frame.

10. The dish holder arrangement according to claim 7 wherein said upwardly extending dish holder elements extend above said rack frame means a distance of approximately 5½ to 6 inches.

11. The dish holder arrangement according to claim 9 wherein said diverging dish holder elements extend from said point whereat said divergent dish holder elements are secured to said dish rack frame means a distance approximately equal to 3 inches.

12. The dish holder arrangement according to claim 1 wherein said rack frame means comprises longitudinally extending spaced pairs of frame members extending along said row of said pairs of dish holder elements and wherein each of said dish holder elements is secured to a respective one of said spaced rack frame means.

13. The dish holder arrangement according to claim 2 wherein each of said diverging dish holder elements extend in a direction directly opposite from the other divergent dish holder element of said pair of divergent elements and then is bent at an inclination towards said preceding pair of said upwardly extending elements.

14. The dish holder arrangement according to claim 13 wherein said inclination of each of said dish holder elements towards said preceding pair of upwardly extending dish holder elements is approximately ⅜ inch and wherein each of said divergent dish holder elements extends upwardly from said rack frame means a distance such that said uppermost portion of said divergent dish holder elements is spaced apart a distance equal to approximately 5½ to 6 inches.

15. The dish holder arrangement according to claim 1 wherein each of said successive pairs of dish holder elements are spaced apart a distance approximately equal to one inch.

16. The dish holder arrangement according to claim 12 wherein each of said upwardly extending dish holder elements extends upwardly from each of said longitudinal respective rack frame means to which said upwardly extending dish holder element is mounted and is inclined outwardly and includes a portion thereof extending away from the opposite one of said pairs of upwardly extending elements in each alternate pair and includes a directly upwardly extending terminal portion thereof, whereby said spacing of said terminal portions is greater than said spacing of said longitudinal members.

17. The dish holder arrangement according to claim 1 wherein said rack frame means includes a peripheral rack frame member extending along side the terminal portion of each of said diverging dish holder elements and wherein said terminal portions of said diverging dish holder elements are secured to said peripheral rack frame members whereby said diverging dish holder elements comprise dish holder knees.

18. The dish holder arrangement according to claim 1 wherein said dish holder elements comprise wire form elements.

19. A dish holding arrangement for plates and bowls comprising:

a rack frame means;

a row of dish holding element pairs mounted to said rack frame means, said dish holding element pairs being of alternate configuration in said row, one of said configurations comprising pairs of elements, each of said elements in said pair extending generally upwardly from said rack frame means and outwardly in a divergent direction from the other element of said pair, and the other configuration comprising pairs of elements, each element in said pair extending generally upwardly essentially parallel to the other element of that pair, allowing bowls to be received over said pairs of elements of said one configuration and engaged between successive dish holding element pairs of said other configuration to maintain a substantially vertical positioning of said bowls, adjacent dish holding element pairs engaging shallower depth plate items disposed therebetween in said row of dish holding element pairs to maintain a substantially vertical positioning of said plates thereon, whereby said arrangement may accommodate both plates and bowls.

* * * * *